US005711743A

United States Patent [19]

Nichols, Jr. et al.

[11] Patent Number: 5,711,743

[45] Date of Patent: Jan. 27, 1998

[54] TRAMPOLINE TENT

[75] Inventors: Albert Gordon Nichols, Jr., Dallas; Jeff Kollmeier, Arlington, both of Tex.; William T. Dalebout, North Logan; Scott R. Watterson, Logan, both of Utah

[73] Assignee: Jumking, Inc., Garland, Tex.

[21] Appl. No.: 719,491

[22] Filed: Sep. 25, 1996

[51] Int. Cl.[6] ..... A63B 5/11; E04H 15/02

[52] U.S. Cl. ..... 482/27; 135/96; 135/133

[58] Field of Search ..... 482/27; 135/96, 135/132, 133, 143, 148, 151, 155, 87, 147; 114/39.1

[56] References Cited

U.S. PATENT DOCUMENTS

| | | | |
|---|---|---|---|
| Re. 30,344 | 7/1980 | McNeil | 482/27 |
| D. 187,138 | 2/1960 | Highberger | 482/27 |
| 3,285,259 | 11/1966 | Hale . | |
| 3,540,458 | 11/1970 | Osterhoudt . | |
| 3,578,003 | 5/1971 | Everett . | |
| 3,601,825 | 8/1971 | Moorhead | 135/96 X |
| 3,848,279 | 11/1974 | Ipsen, Jr. . | |
| 3,848,615 | 11/1974 | Warner | 135/132 |
| 3,906,968 | 9/1975 | Black | 135/132 |
| 3,995,649 | 12/1976 | Robichaud . | |
| 4,091,484 | 5/1978 | Means . | |
| 4,433,838 | 2/1984 | Gordon . | |
| 4,766,830 | 8/1988 | Kunz | 114/61 |
| 5,004,001 | 4/1991 | Bouchard | 135/133 X |
| 5,012,753 | 5/1991 | Grassi | 114/39.1 |
| 5,240,021 | 8/1993 | Snodgrass . | |

FOREIGN PATENT DOCUMENTS

| | | | |
|---|---|---|---|
| 84115962 | 5/1984 | European Pat. Off. | 482/27 |

*Primary Examiner*—Richard J. Apley
*Assistant Examiner*—William LeMarca
*Attorney, Agent, or Firm*—Workman Nydegger Seeley

[57] ABSTRACT

A tent is provided for selective attachment to a conventional trampoline. The tent includes a low profile domed shell having a base that is removably secured around the perimeter of the trampoline. A pair of primary support rods are hingedly mounted on opposing sides of the trampoline and are biased against the shell to keep the shell elevated off of the trampoline. An adjustable support rod has opposing ends slidably mounted to opposing ends of one of the primary support rods. By disconnecting the shell from the trampoline along one side of the trampoline, the shell and support rods can be folded about the opposing side of the trampoline. An apron is attached to the shell along the opposing side of the trampoline and is configured to enclose the shell and support rods below the top of the trampoline. Ties are then used to secure the apron around the shell which is connected to the trampoline frame.

19 Claims, 5 Drawing Sheets

TRAMPOLINE TENT

BACKGROUND OF THE INVENTION

1. The Field of the Invention

The present invention relates to trampoline covers and, more specifically, collapsible tents that can selectively be mounted on a trampoline.

2. The Relevant Technology

Trampolines are found and used in a variety of environments. Typically, however, trampolines are found in the backyards of homes where they are primarily used by children. In such an environment, a trampoline is typically openly exposed to natural elements such as rain, sun, wind, and the like. To protect the trampoline from such elements when not in use, covers have been placed over trampolines. Conventional covers typically comprise canvas or plastic sheets which are simply tied or secured over the top of the trampoline. Although useful in achieving one objective, simply placing a cover over the trampoline does not achieve other objectives which are often desirable to a homeowner. For example, at times it is desirable to prevent unwanted access to the trampoline. Simply placing a cover over the trampoline does not prevent unwanted use since individuals can still jump on the trampoline with the cover attached thereto.

In addition, it is often desirable for children or adults to sleep on the bed of the trampoline. In such situations, it is often beneficial to have a cover which can not only protect those sleeping on the trampoline from the weather, but will also close off the trampoline from bugs and insects. It would also be beneficial if the trampoline cover would help prevent children from rolling off the trampoline.

Although prior uses have placed conventional tents on trampolines, such a combination creates its own problems. For example, most tents positioned on a trampoline encourage children to jump on the trampoline inside the tent. Such a scenario is not only dangerous to the tent, but is also dangerous to the child. Jumping on the trampoline within the tent could potentially cause head or neck injury as a result of striking the roof of the tent.

Another problem with placing a conventional tent on a trampoline is that the tents are typically difficult and time consuming to both assemble and disassemble. Furthermore, the tent is generally required to be fully disassembled to enable conventional use of the trampoline. This is especially bothersome if it is desirable to set the tent up each night and then take the tent down each morning.

OBJECTS AND BRIEF SUMMARY OF THE INVENTION

Accordingly, it is an object of the present invention to provide improved tent covers for trampolines.

Another object of the present invention is to provide tent covers for trampolines which not only protect a trampoline from the weather and other natural elements, but also prevent unwanted access to the trampoline.

Still another objective of the present invention is to provide tent covers for trampolines which enable covered sleeping on a trampoline but discourages jumping on the trampoline within the tent.

Another object of the present invention is to provide tent covers that are easily assembled to cover a trampoline and easily disassemble to allow conventional use of the trampoline.

Finally, another object of the present invention is to provide tent covers that can be collapsed to allow conventional use of the trampoline without having to be completely disassembled and disconnected from the trampoline.

To achieve the foregoing objects, and in accordance with the invention as embodied and broadly described herein a tent is provided for attachment to a conventional trampoline. The tent comprises a shell having an annular base configured for selective and removable attachment around the perimeter of the trampoline. The shell preferably has a low profile, domed configuration. The term "low profile" means that the maximum height of the shell is smaller than the maximum radius at the base of the shell. The shell is preferably made of a soft foldable material such as canvas or nylon which enables the shell to be selectively folded around a portion of the frame of the trampoline.

The tent further includes a plurality of support rods which are mounted to the trampoline frame. The support rods are used for supporting the shell above the bed of the trampoline. In the preferred embodiment, a clamp having a pivot pin projecting therefrom is attached to the frame of the trampoline on each of the opposing sides of the trampoline. The plurality of support rods include a pair of primary support rods having opposing ends that are pivotally attached to the pivot pins on opposing sides of the trampoline. The support rods also include an adjustable support rod having an opposing ends. The opposing ends of the adjustable support rod are both slidably and hingably attached to the opposing ends of one of the primary support rods.

The primary support rods preferably have an inside radius that is greater than the outside radius of the frame of the trampoline. As such, the primary support rods can be folded around the outside of the frame of the trampoline so as to be selectively positioned below the top surface of the trampoline. The adjustable support rod has a radius that is smaller than the outside radius of the trampoline, thereby facilitating the construction of the low profile, domed tent. The effective radius of the adjustable support rod is increased, however, by sliding the ends of the adjustable support rod along the attached primary support rod. As a result, the adjustable support rod can also be folded around the outside edge of the trampoline frame.

An apron is attached around a portion of the trampoline and is preferably connected to the shell. The apron can be secured around the support rods and shell when the support rods and shell are in the folded down position. In this way, the apron functions to cover and secure the support rods and shell below the top surface of the trampoline.

The inventive tent can easily and quickly be placed in an upstanding position or in the folded down position. The ease in positioning the tent stems in part from the fact that the support rods need not be disconnected from the frame but can simply be hingedly rotated between an upstanding position and a collapsed, storage position. Likewise, since the tent and support rods are stored below the trampoline, the trampoline can be used in a conventional manner without any additional hazards resulting from the tent. Furthermore, as a result of the tent having a low profile configuration, the minimal height between the bed of the trampoline and the roof of the tent discourages jumping on the trampoline within the tent.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
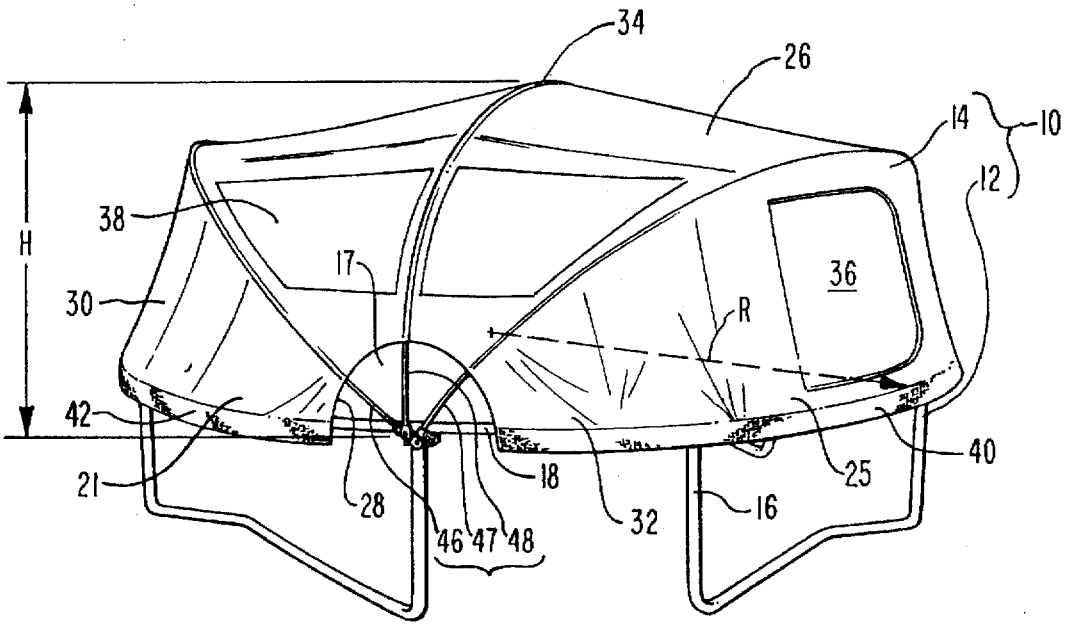
FIG. 1 is a perspective view of an inventive tent mounted on a trampoline.
Figure 5:
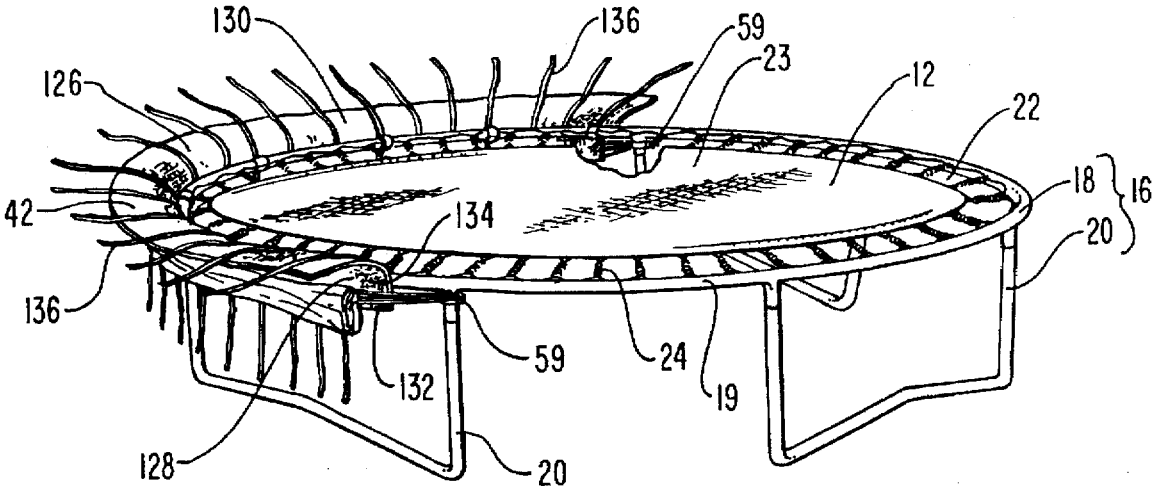
FIG. 5 is a perspective view of the tent shown in FIG. 1 in a collapsed, storage position.

Depicted in FIG. 1 is a perspective view of a trampoline assembly 10 comprising a trampoline 12 having one embodiment of a tent 14 removably attached thereto. As depicted in FIG. 5, trampoline 12 comprises a frame 16 which includes an annular mounting bar 18 and a plurality of legs 20 projecting therefrom. Mounting bar 18 is shown as having a top surface 19 and a perimeter which bounds an opening 22. Disposed within opening 22 is a flexible bed 23.

The present invention also provides means for connecting frame 16 to flexible bed 23. By way of example and not by limitation, one embodiment of this means includes a plurality of springs 24 that extend between mounting bar 18 and bed 23 at regularly spaced intervals around mounting bar 18. In alternative embodiments, elastomeric cords or straps could be used. Although mounting bar 18 is shown in FIG. 5 as having a perimeter that is substantially circular, it is noted that mounting bar 18 can likewise have other geometrical shapes such as a square, rectangle, oval, or any other desired shape.

Referring again to FIG. 1, tent 14 is shown as comprising a shell 26 having a low profile, domed configuration. More specifically, shell 26 has an interior surface 28 and an exterior surface 30. Extending through shell 26 is a door 36 and a plurality of windows 38. Shell 26 also has an annular base 32 that is configured to extend around the perimeter of frame 16. Although base 32 is also shown as being substantially circular, base 32 can also be configured so as to correspond to the geometrical shape of frame 16 of trampoline 12. Base 32 is defined in part as having a maximum radius R. Shell 26 further has a top 34 and maximum height H which is the distance between base 32 and top 34. Shell 26 can be made of any soft, foldable material. Such materials include, for example, canvas, cotton, nylon, or other synthetic materials.

A pair of cut outs 17 each having a semi-circular configuration are formed at base 32 and are positioned at opposing sides of shell 26. Cut outs 17 divide base 32 into a first base portion 21 and a second base portion 25. Attached to first base portion 21 of shell 26 is an apron 42. Apron 42 will be discussed later in greater detail. Attached to second base portion 25 of shell 26 is a trim 40. Trim 40 extends below mounting bar 18 so as to substantially cover mounting bar 18.

Tent 14 further includes a plurality of support rods 44. Support rods 44 include primary support rods 46 and 47 and an adjustable support rod 48. Each of support rods 44 can be formed as a unitary, arcuate pole. It is preferred, however, that each support rod 44 comprise a plurality of short sections of flexible rod, such as those used in conventional camping tents, which are interconnected to form the desired length of support rods 44. As such, support rods 44 can be manufactured from fiberglass, aluminum, composites, or other materials which have resiliently flexible properties.

Figure 2:
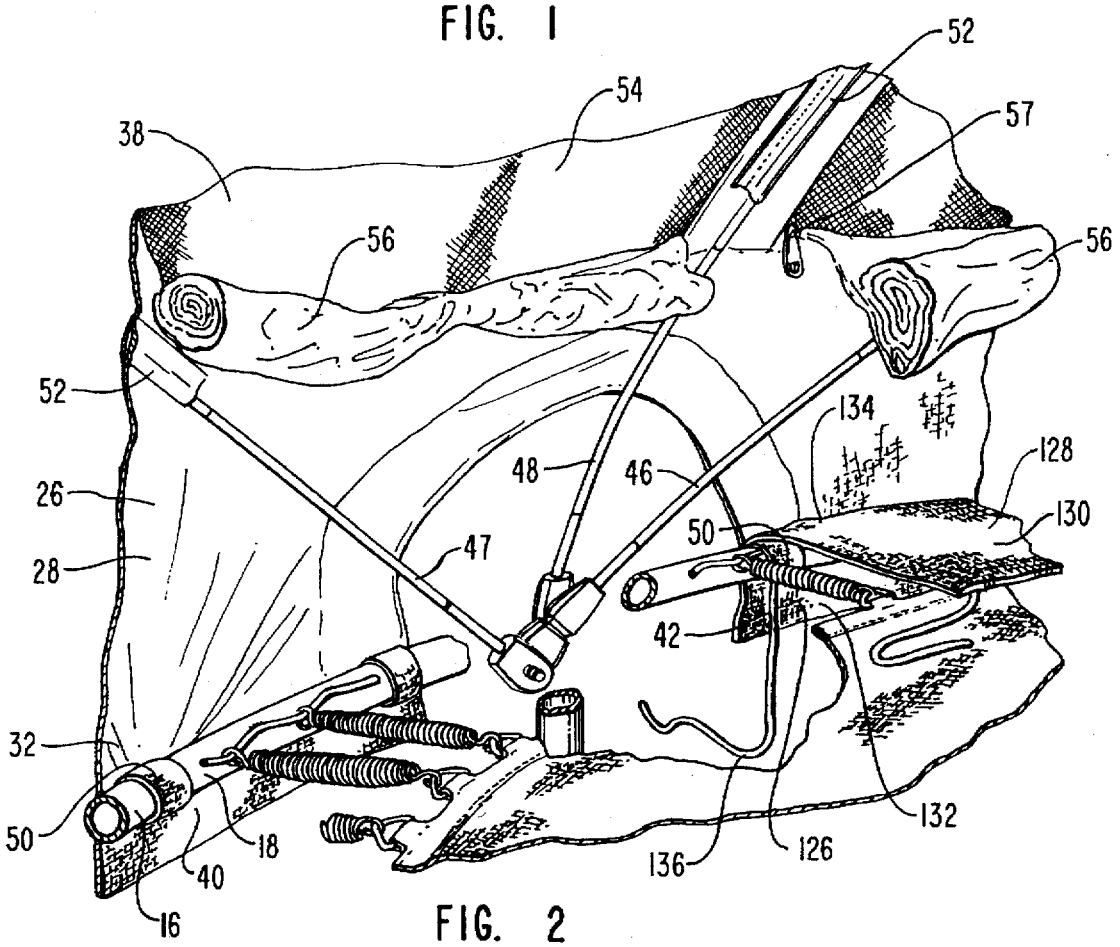
FIG. 2 is a perspective view of a portion of the inside of the tent shown in FIG. 1.

In one embodiment of the present invention, means are provided for removably connecting base 32 of shell 26 to frame 16. By way of example and not by limitation, as depicted in FIG. 2, a plurality of straps 50 are attached to interior surface 28 at base 32 of shell 26. Straps 50 can be selectively connected to mounting bar 18 so as to secure base 32 to frame 16. Straps 50 can include any conventional type of strapping material, such as cord or straps with hook and loop fasteners. In the preferred embodiment, straps 50 comprise nylon webbing straps with Velcro® attached thereto. The means for connecting can also include conventional latching structures as snaps, hook and eye configurations, or various tongue and groove configurations.

In yet another embodiment of the present invention, means are also provided for attaching the support rods 44 to shell 26. By way of example and not by limitation, one embodiment of this means includes elongated sleeves 52 shown mounted on interior surface 28 of shell 26. Each of sleeves 52 is configured to receive one of the support rods 44 and is selectively positioned so as to maintain support rod 44 in the desired location for supporting shell 26. In alternative embodiments, sleeves 52 can also be placed on exterior surface 30 of shell 26. In yet other embodiments, discrete rings or loops could be used to replace elongated sleeves 52. It is also envisioned that grooved recesses could be formed on interior surface 28 of shell 26 to securely capture support rods 44.

As also shown in FIG. 2, windows 38 can be covered by netting 54. In addition, covers 56 can also be used in conjunction with zippers 57 to selectively close off windows 38. Similar covers 56 can also be used to selectively close off door 36. If desired, conventional locking structures, such as padlocks, can be attached to the door zipper, to prevent unwanted entrance into tent 14.

Figure 3:
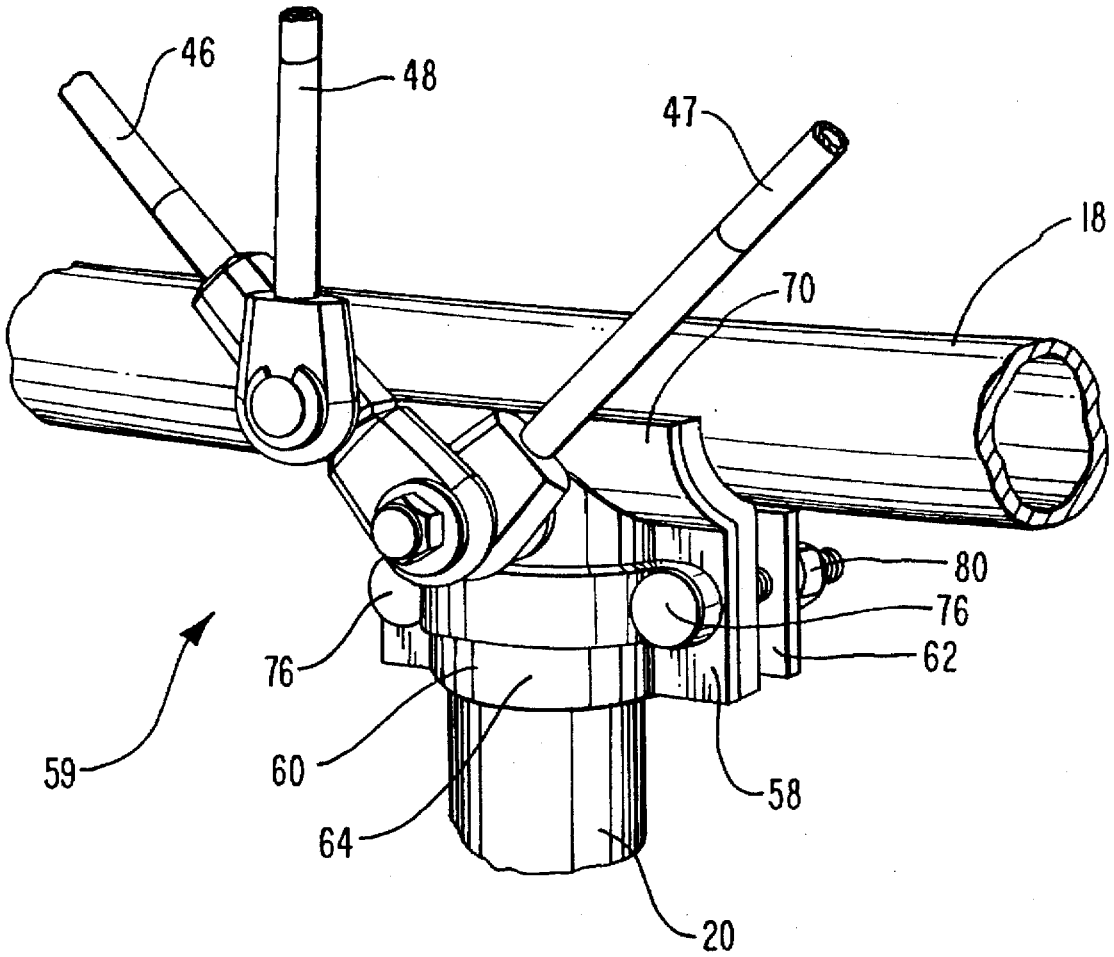
FIG. 3 is an enlarged perspective view of the hinge assembly used for connecting the support rods of the tent shown in FIG. 1 to the trampoline.
Figure 4:
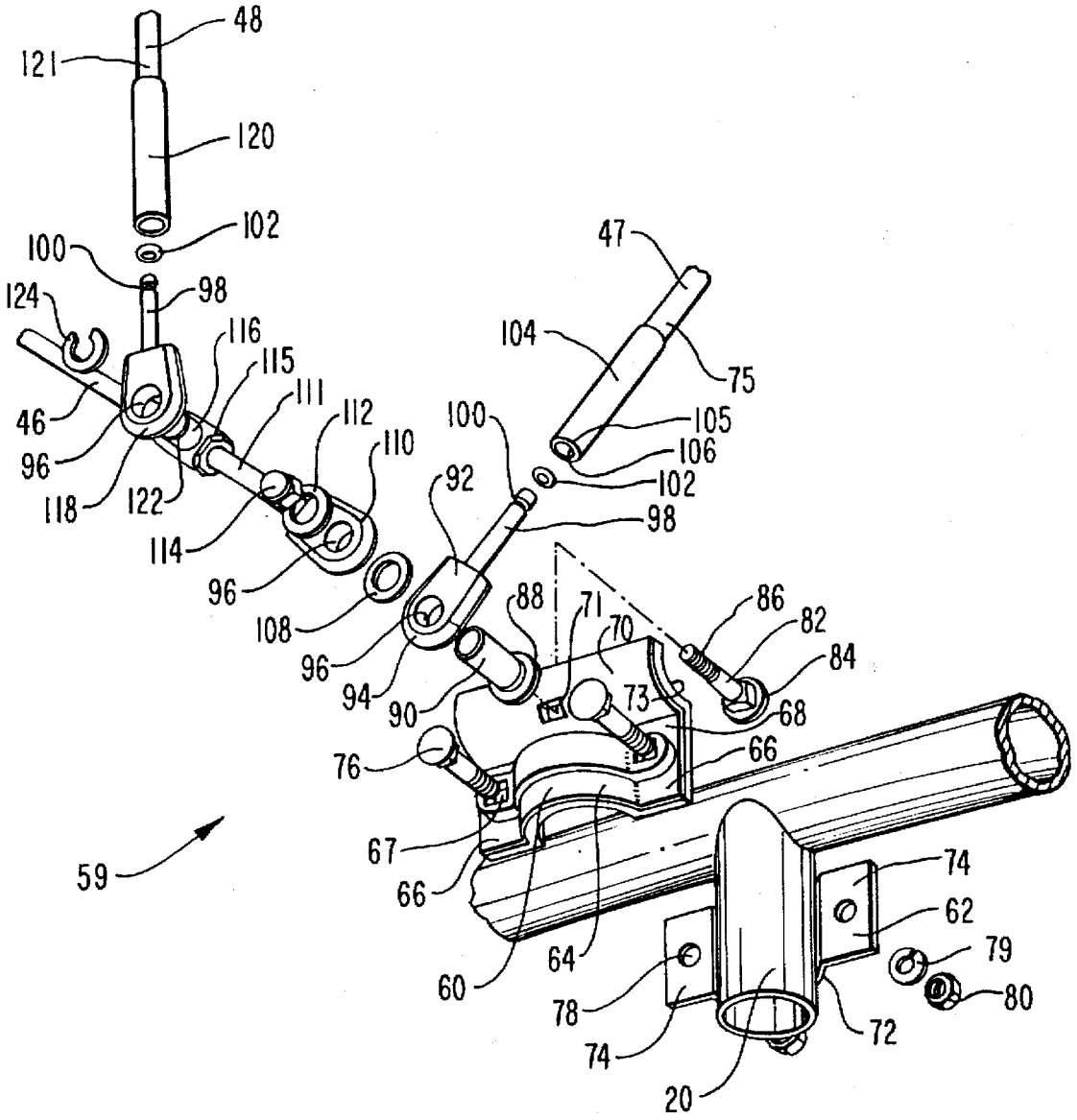
FIG. 4 is an exploded perspective view of the hinge assembly shown in FIG. 3.

In yet another embodiment of the present invention, means are also provided for folding the plurality of support rods 44 about frame 16 of trampoline 12 to enable bed 23 of trampoline 12 to be uncovered while maintaining the plurality of support rods 44 mounted to frame 16. By way of example and not by limitation, depicted in FIGS. 3 and 4 is a hinge assembly 59 mounted to frame 16. Hinge assembly 59 is shown as comprising a leg clamp 58 that is selectively mounted to leg 20 and biased against mounting bar 18. Leg clamp 58 is shown as comprising a front bracket 60 and a rear bracket 62. As best shown in FIG. 4, front bracket 60 is shown as comprising a vertically oriented C-clamp 64 with wings 66 projecting from opposing sides thereof. Wings 66 define apertures 67 extending therethrough. Mounted to a top edge 68 of front bracket 60 is a horizontally disposed C-clamp 70. As will be discussed later in greater detail, C-clamp 70 also defines an aperture 71 extending therethrough.

In like manner to front bracket 60, rear bracket 62 includes a vertically disposed C-clamp 72 with wings 74 extending from opposing sides thereof. Wings 74 also define apertures 78 extending therethrough. As best shown in FIG. 3, C-clamps 64 and 72 can be secured around leg 20 and then fastened in place by passing carriage bolts 76 through aligned apertures 67 and 78. A lock washer 79 and nut 80 are then attached to each of bolts 76. By biasing horizontal C-clamp 70 against mounting bar 18, leg clamp 58 is prevented from rotating about leg 20.

FIG. 4 also discloses a carriage bolt 82 having an enlarged head 84 and a threaded end 86. Threaded end 86 is advanced from a back side 73 of horizontal C-clamp 70 through aperture 71 so that head 84 is biased against back side 73 and threaded end 86 projects through aperture 71. In this position, carriage bolt 82 is one embodiment of the "pivot pin" as recited in the appended claims. Once carriage bolt 82 is so positioned, a washer 88 and cylindrical sleeve 90 are received over carriage bolt 82.

Also depicted in FIG. 4 is a pole end 92 for selective attachment to primary support rod 47. Pole end 92 includes an enlarged head 94 with an aperture 96 extending therethrough. Projecting from head 94 is an elongated stem 98 having an annular groove 100 radially encircling stem 98. Groove 100 is configured to snugly receive a rubber O-ring 102. As also shown in FIG. 4, primary support rod 47 has an end 75 with a connecting sleeve 104 attached thereto. Connecting sleeve 104 has a terminus 105 with a receiving chamber 106 formed therein. With O-ring 102 received within groove 100 on stem 98, stem 98 can be snugly inserted within receiving chamber 106 of connecting sleeve 104. Pole end 92 can be advanced so that sleeve 90 is received through aperture 96 after which a washer 108 is also advanced over sleeve 90 and biased against pole end 92. In this configuration, pole end 92 is both rigidly and removably connected to end 75 of primary support rod 47 and is rotatably mounted about carriage bolt 82.

FIG. 4 also shows a pole end 110 that is connected to an end 111 of primary support rod 46. Pole end 110 has the same configuration as pole end 92 and is attached to primary support rod 46 in the same way in which pole end 92 is attached to primary support rod 47. Like structural elements between pole end 110 and pole end 92 are given like reference characters.

Following the attachment of washer 108 over sleeve 90, pole end 110 is mounted on sleeve 90 by passing sleeve 90 through aperture 96. Next, a washer 112 is passed over sleeve 90. Finally, a threaded cap 114 is secured to threaded end 86 of carriage bolt 82 which extends past the end of sleeve 90. As such, pole ends 92 and 110 are rotatably secured around carriage bolt 82. Washers 88, 108, and 112 help to reduce frictional engagement and provide free rotation for each of pole ends 92 and 110.

In one embodiment of the present invention, means are provided for hingedly and slidably connecting an end of the adjustable support rod 48 to primary support rod 46. By way of example and not by limitation, slidably received on end 111 of primary support rod 46 is a collar 115. Radially projecting out from collar 114 is a pin 116. An annular groove 122 is recessed around pin 116. To connect adjustable support rod 48 to collar 114, a pole end 118 is provided.

Pole end 118 has the same structural configuration as pole end 92 and is attached to adjustable support rod 48 in the same way in which pole end 92 is attached to primary support rod 47. Like structural elements between pole end 118 and pole end 92 are given like reference characters. Accordingly, by attaching an O-ring 102 within groove 100 on stem 98, stem 98 of pole end 118 can be secured within a connecting sleeve 120 mounted at an end 121 of adjustable support rod 48. Pin 122 is then passed through aperture 96 on pole end 118. Finally, a C-shaped snap ring 124 is secured within groove 122, thereby allowing free rotation of pole end 118 around pin 116 but preventing unwanted removal of pole end 118 from pin 116.

As best depicted in FIG. 5, hinge assembly 59 is used for connecting each of the opposing ends of support rods 44 to legs 20 positioned on opposing sides of trampoline 12. In this configuration, support rods 44 span across trampoline 12 and can selectively be positioned in either an upstanding position, wherein the tent is deployed above the trampoline bed, or a folded or collapsed position, wherein the tent is stored outside the periphery and below the trampoline frame. As depicted in FIGS. 1 and 2, support rods 44 are in an upstanding position. In this position, support rods 44 are appropriately spaced apart to support shell 26 in an elevated position off from bed 23. More specifically, primary or outer support rods 46 and 47 are angled towards the perimeter of frame 16 while adjustable or center support rod 48 is substantially vertically oriented.

One of the novel features of the present invention is the low profile configuration of tent 14. The term "low profile" as used in the specification and appended claims, is intended to mean that the maximum height H of tent 14 is smaller than the maximum inside radius R of tent 14. By tent 14 having a low profile configuration, top 34 is positioned closer to bed 23. Height H is preferably in a range between about 3 feet to about 5 feet, more preferably in a range from between about 4 feet to about 5 feet, and most preferably about 4.5 feet. As a result of the minimized space between bed 23 and top 34, bouncing on bed 23 when tent 14 is in an upstanding position is discouraged. Since bouncing on bed 23 when tent 14 is in an upstanding position can potentially damage the tent and cause injury to the person bouncing, the low profile configuration of tent 14 is an added safety feature.

Another benefit of the present invention is that tent 14 can be folded down to enable conventional use of trampoline 12 without having to disconnect support rods 44 from frame 16. As shown in FIG. 5, to accomplish this, second base portion 25 of shell 26 is disconnected from frame 16. With this portion of shell 26 disconnected, shell 26 and support rods 44 can be freely pivoted and folded toward the opposite side of trampoline 12. Support rods 44 are folded by selectively pivoting about hinge assemblies 59 located on the opposing sides of frame 16. It is preferred that primary support rods 46 have an inside radius that is slightly larger than the outside radius of mounting bar 18. Said another way, primary support rods 46 and 47 are slightly longer than the length equal to one-half the circumference of mounting bar 18. As a result, when primary support rods 46 and 47 are pivoted about frame 16, primary support rods 46 and 47 pass around the outside of mounting bar 18 so as to be disposed below top surface 19 of mounting bar 18.

To enable a low profile configuration of tent 14, however, adjustable support rod 48 necessarily has a smaller inside radius than does primary support rods 46 and 47. In other words, adjustable support rod 48 is substantially shorter than the length equal to one-half the circumference of mounting bar 18. Accordingly, to also enable adjustable support rod 48 to pass around the outside of mounting bar 18, collar 114 is allowed to freely slide along primary support rod 46 so as to effectively increase the inside radius of adjustable support rod 48 so as to approximate the radius of, and to align adjustable support rod 48 with, primary support rods 46 and 47. As such, adjustable support rod 48 is also able to pass around mounting bar 18 so as to be selectively disposed below mounting bar 18.

As previously discussed, the opposing ends of adjustable support rod 48 are preferably both slidably and hingably connected to the opposing ends of primary support rod 46 by use of collars 115. In alternative embodiments, it is noted that the effective radius for allowing adjustable support rod 48 to pass around the perimeter of frame 16 can also be obtained by having only one of the ends of adjustable support rod 48 be both slidably and hingedly connected while the opposing end be only hingedly connected.

Just as with adjustable support rod 48, it is also necessary for top 34 of shell 26 to have an effective increase in radius or height to enable top 34 to pass around mounting bar 18. More specifically, top 34 includes that portion of shell 26 which when in an upstanding position has a height H that is smaller than the maximum radius R of trampoline 12. To enable all of shell 26 to pass around the outside of mounting bar 18, cut outs 17 are positioned on opposing sides of top 34 adjacent to hinge assemblies 59. Cut outs 17 are configured so that when support rods 44 are collapsed together, cut outs 17 enable top 34 to radially expand outward so as to pass around mounting bar 18. In this way, shell 26 and support rods 44 can be stored below mounting bar 18.

Although cut outs 17 are shown having a semi-circular configuration, cut outs 17 can have a variety of configurations. For example, cut outs 17 can be square or triangular. In addition, a single cut out 17 may also be effective in adjusting shell 26 to pass around mounting bar 18. In yet another alternative embodiment, flaps can be attached to cover each of cut outs 17. In this way, the flaps help to further enclose trampoline 12.

The present invention also provides means for securing support rods 44 and shell 26 below top surface 19 of frame 16 when support rods 44 are folded over. By way of example and not by limitation, as best depicted in FIGS. 2 and 5, apron 42 is shown as having an interior surface 126 and an exterior surface 128. Apron 42 also includes a top portion 130, a bottom portion 132, and a middle portion 134 extending therebetween. In the preferred embodiment, exterior surface 128 of middle portion 134 is connected to base 32 of shell 26. In addition, straps 50 are secured to interior surface 126 of middle portion 134. As shown in FIG. 2, straps 50 are used for connecting apron 42 and shell 26 to mounting bar 18. In the position shown in FIG. 2, top portion 130 of apron 42 extends above mounting bar 18 while bottom portion 132 of apron 42 extends below mounting bar 18. Also mounted on interior surface 126 of middle portion 134 are a plurality of ties 136 that are located at regular intervals along the length of apron 42.

Figure 6:
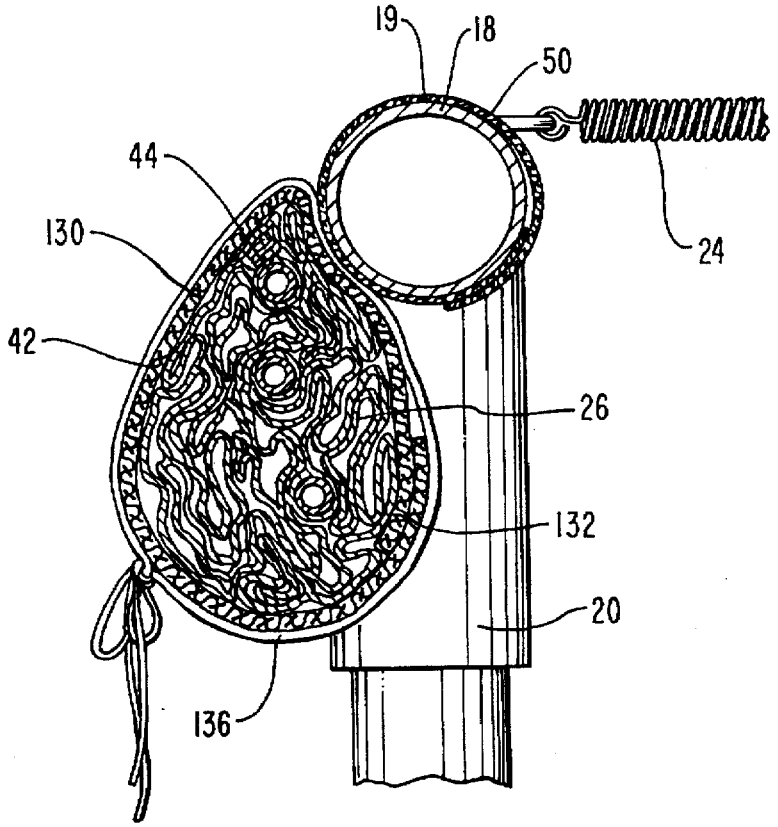
FIG. 6 is a cross-sectional side view of the tent in a collapsed, storage position, as shown in FIG. 5, and being wrapped in an apron.

As best seen in FIG. 5, shell 26 and support rods 44 can be folded so as to be positioned between top portion 130 and bottom portion 132 of apron 42. In this position, as shown in FIG. 6, top portion 130 and bottom portion 132 of apron 42 can be wrapped around support rods 44 and shell 26 so as to substantially enclose them. Next, ties 136 can be secured around apron 142 so as to securely hold shell 26 and support rods 44 within apron 42.

Since tent 14 is not completely removed from frame 16, tent 14 is quickly and easily positioned between the upstanding and folded positions and vice versa. Furthermore, by positioning tent 14 outside and substantially below mounting bar 18, trampoline 12 can be used in a conventional manner without any additional hazards arising from the attachment of tent 14. For example, tent 14 is not an obstacle for the user nor does tent 14 hinder the attachment of safety pads which are traditionally connected between bed 23 and mounting bar 18.

Figure 7:
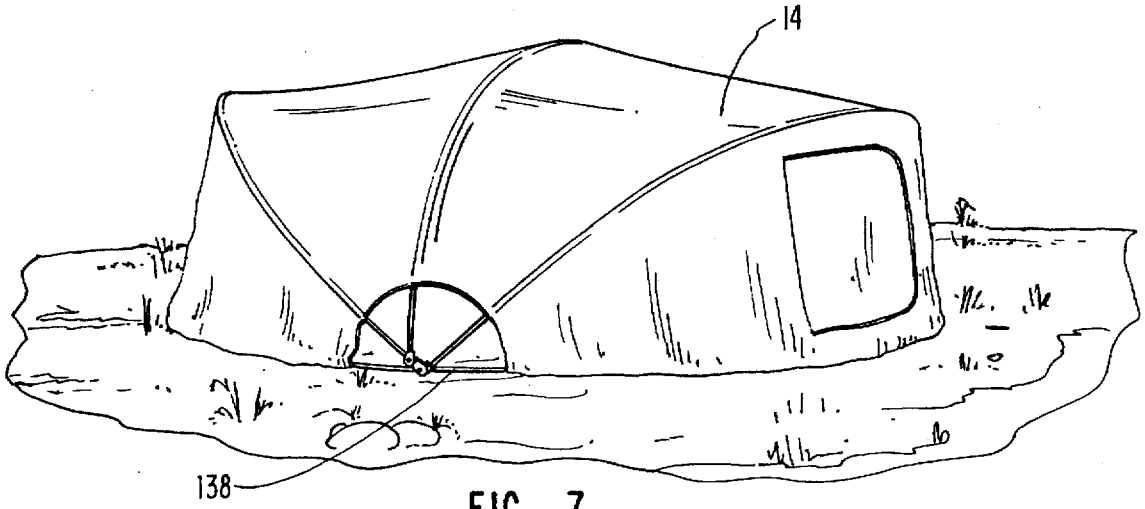
FIG. 7 is a perspective view of an alternative use of the tent shown in FIG. 1.

Although tent 14 is shown and discussed as being configured for attachment to a trampoline 12, it is also noted that tent 14 has a variety of unique features which enables it to be used in a variety of alternative configurations. For example, as depicted in FIG. 7, tent 14 can be selectively attached to a frame 138 for use as a conventional camping tent. Such a tent enables quick assembly and disassembly and also enables quick opening and closing. In alternative embodiments, tent 14 could also be used for covering patios or housing alternative structures.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A foldable tent apparatus for attachment to a trampoline assembly comprising a trampoline having a frame, a flexible bed disposed within the frame, and spring means for connecting the flexible bed to the frame, said tent apparatus comprising:

shell means for forming a protective tent shelter that covers said flexible bed of the trampoline, and which is foldable from a first position wherein the shell means is fully opened so as to be supported above and so as to provide a tent shelter over the flexible bed, to a second position wherein the shell means is collapsed for storage about the periphery of said trampoline frame so as to permit the flexible bed to be usable for jumping;

a plurality of primary flexible support rods each having a first length, and at least one adjustable flexible support rod having a second length that is shorter than said first length but which is long enough to accommodate adjustable movement from said first position wherein said adjustable flexible support rod is essentially vertically oriented, to said second position wherein said adjustable flexible support rod is essentially arcuately aligned with said primary flexible support rods to accommodate storage, each said flexible rod having first and second ends and said flexible support rods together providing a supporting framework by which said shell means is supported over said flexible bed of the trampoline, and the length of the adjustable flexible support rod being such as to provide a tent shelter having a low center profile when in the first, opened position; and a pair of hinge means, adapted for releasable attachment to opposing sides of said trampoline frame, for providing pivotal support to said first and second ends of each flexible support rod at an essentially common point on said opposing sides, each said hinge means comprising:

releasable clamp means for attachment to said opposing sides of said trampoline frame, said releasable clamp means comprising means for pivotal attachment of one of the first or second ends of the primary flexible support rods, such that said primary flexible support rods can be pivoted together when collapsing said shell means for storage, or such that said primary flexible support rods can be pivoted away from each other when opening the shell means to provide said tent shelter; and slidable collar means for providing pivotal attachment of one of the first or second ends of the adjustable flexible support rod to one of said primary flexible support rods along the length thereof, and for providing sliding adjustment of the ends of said adjustable flexible support rod along said length of said primary flexible support rod between a storage position so as to permit arcuate alignment of the adjustable flexible support rod with the primary flexible support rods as they are pivoted together when collapsing the shell means to the second position for storage of the shell means, and a support position wherein the slidable collar means is slidable into contact with one or the other of said means for pivotal attachment so that the adjustable flexible support rod is essentially vertically oriented for center support of the shell means.

2. A trampoline assembly comprising:

(a) a trampoline comprising:

(i) a frame having a top surface and a perimeter bounding an opening;

(ii) a flexible bed disposed within the opening; and (iii) means for connecting the frame to the flexible bed;

(b) a tent comprising:

(i) shell means for forming a protective tent shelter that covers said flexible bed of the trampoline, and which is foldable from a first position wherein the shell means is fully opened so as to be supported above and so as to provide a tent shelter over the flexible bed, to a second position wherein the shell means is collapsed for storage about the periphery of said trampoline frame so as to permit the flexible bed to be usable for jumping;

(ii) a plurality of primary flexible support rods each having a first length, and at least one adjustable flexible support rod having a second length that is shorter than said first length but which is long enough to accommodate adjustable movement from said first position wherein said adjustable flexible support rod is essentially vertically oriented to said second position wherein said adjustable flexible support rod is essentially arcuately aligned with said primary flexible support rods to accommodate storage, each said flexible rod having first and second ends and said flexible support rods together providing a supporting framework by which said shell means is supported over said flexible bed of the trampoline, and the length of the adjustable flexible support rod being such as to provide a tent shelter having a low center profile when in the first, opened position and (iii) a pair of hinge means, adapted for releasable attachment to opposing sides of said trampoline frame, for providing pivotal support to said first and second ends of each flexible support rod at an essentially common point on said opposing sides, each said hinge means comprising:

(A) releasable clamp means for attachment to said opposing sides of said trampoline frame, said releasable clamp means comprising means for pivotal attachment of one of the first or second ends of the primary flexible support rods, such that said primary flexible support rods can be pivoted together when collapsing said shell means for storage, or such that said primary flexible support rods can be pivoted away from each other when opening the shell means to provide said tent shelter; and (B) slidable collar means for providing pivotal attachment of one of the first or second ends of the adjustable flexible support rod to one of said primary flexible support rods along the length thereof, and for providing sliding adjustment of the ends of said adjustable flexible support rod along said length of said primary flexible support rod between a storage position so as to permit arcuate alignment of the adjustable flexible support rod with the primary flexible support rods as they are pivoted together when collapsing the shell means to the second position for storage of the shell means, and a support position wherein the slidable collar means is slidable into contact with one or the other of said means for pivotal attachment so that the adjustable flexible support rod is essentially vertically oriented for center support of the shell means; and (c) means for securing each said support rod and the shell means below the top surface of the frame when the shell means is in the second, collapsed position.

3. A trampoline assembly as recited in claim 2, wherein the means for securing comprises an apron attached to the frame and extending around a portion of the perimeter of the frame, the apron being configured to substantially capture each said support rod and the shell means.

4. A trampoline assembly as recited in claim 3, wherein the apron comprises:

(a) a top portion projecting above the frame;

(b) a bottom portion projecting below the frame; and (c) a middle portion extending between the top portion and the bottom portion.

5. A trampoline assembly as recited in claim 4, wherein the middle portion of the apron is connected to the shell means.

6. A trampoline assembly as recited in claim 3, further comprising a plurality of ties positioned adjacent to the apron so as to selectively secure the apron about each support rod and the shell means.

7. A trampoline assembly as recited in claim 2, wherein each hinge means comprises a pivot pin projecting from the frame at opposing sides of the frame and wherein each support rod has opposing ends hingedly mounted to the pivot pins, and wherein said slidable collar means comprises a collar slidably mounted on each of the opposing end of one of the support rods, and wherein the flexible adjustable support rod has opposing ends hingedly mounted to each of the collars.

8. A trampoline assembly as recited in claim 7, wherein the frame further comprises a plurality of legs projecting therefrom, the pivot pins being mounted on the legs.

9. A trampoline assembly as recited in claim 2, wherein the perimeter of the frame is circular.

10. A trampoline assembly as recited in claim 2, wherein the means for connecting the frame to the flexible bed comprises a plurality of springs extending between the flexible bed and the frame.

11. A trampoline assembly comprising:

(a) a trampoline comprising:

(i) a frame having a perimeter bounding an opening;

(ii) a flexible bed disposed within the opening; and (iii) a plurality of springs extending between the frame and the flexible bed;

a low profile, domed shell made of a foldable material and comprising:

(i) a base having a maximum inside radius and being configured to be selectively, removably secured around the perimeter of the frame so that the shell covers the bed;

(ii) a top having a maximum height that is smaller than the maximum inside radius;

(c) a pair of primary support rods having opposing ends hingedly mounted to the frame on opposing sides of the frame, each of the primary support rods having an inside radius that is greater than the maximum height of the domed shell, (d) an adjustable support rod having opposing ends, the adjustable support rod having an inside radius that is equivalent to the maximum height of the domed shell; and (e) means for hingedly and slidably connecting the opposing ends of the adjustable support rod to corresponding opposing ends of one of the primary support rods so as to provide sliding adjustment of the ends of said adjustable support rod along the length of said one primary flexible support rod, thereby permitting arcuate alignment of the adjustable support rod with the primary flexible support rods as they are pivoted together when collapsing the shell for storage, and also sliding into contact with the hingedly mounted ends of said one primary support rod so that the adjustable support rod is essentially vertically oriented for center support of the shell when the shell is unfolded to its open position covering the trampoline.

12. A trampoline assembly as recited in claim 11, wherein the means for hingedly and slidably connecting comprises a collar slidably mounted to each of the opposing ends of one of the primary support rods.

13. A trampoline assembly as recited in claim 12, wherein the means for hingedly and slidably connecting further comprises a pin projecting from each collar, the opposing ends of the adjustable support rod being hingedly connected to each pin.

14. A trampoline assembly as recited in claim 11, further comprising:

(a) a clamp secured to opposing sides of the frame;

(b) a pivot pin connected to each of the clamps; and (c) the opposing ends of each of the pair of primary support rods being rotatably connected to each of the pivot pins attached to the clamps.

15. A trampoline assembly as recited in claim 11, wherein the perimeter of the frame is circular.

16. A trampoline assembly as recited in claim 11, further comprising means for connecting the primary support rods to the shell.

17. A trampoline assembly as recited in claim 11, wherein the means for connecting the primary support rods to the shell comprises the shell having an interior surface with loops formed thereon, the loops being configured to receive the primary support rods.

18. A trampoline assembly as recited in claim 11, further comprising an apron attached to the frame and extending around a portion of the perimeter of the frame, the apron being configured to fold around the shell and the plurality of support rods when the shell and rods have been folded to one side of the frame.

19. A trampoline assembly as recited in claim 11, wherein the shell further comprises a cut out formed at the base thereof.

* * * * *

UNITED STATES PATENT AND TRADEMARK OFFICE

CERTIFICATE OF CORRECTION

PATENT NO. : 5,711,743

DATED : Jan. 27, 1998

INVENTOR(S) : Albert Gordon Nichols, Jr; Jeff Kollmeier; William T. Dalebout; Scott R. Watterson

It is certified that error appears in the above-identified patent and that said Letters Patent is hereby corrected as shown below:

Col. 2, line 24, after "having" delete --an--

Col. 2, line 25, after "and" change "hingably" to --hingedly--

Col. 5, line 60, after "collar" change "114" to --115--

Col. 5, line 62, after "collar" change "114" to --115--

Col. 6, line 4, after "Pin" change "122" to --116--

Col. 6, line 63, after "collar" change "114" to --115--

Col. 7, line 5, after "and" change "hingably" to --hingedly--

Col. 7, line 59, after "apron" change "142" to --42--

Col. 11, line 1, before "a low" insert --(b)--

Signed and Sealed this

Twenty-third Day of February, 1999

*Attest:*

Q. TODD DICKINSON

*Attesting Officer*

*Acting Commissioner of Patents and Trademarks*